US007946139B2

(12) United States Patent
Gill et al.

(10) Patent No.: US 7,946,139 B2
(45) Date of Patent: May 24, 2011

(54) METHOD AND APPARATUS FOR UPGRADING WASHING MACHINE WATER EFFICIENCY

(75) Inventors: David C. Gill, North Providence, RI (US); Eric K. Larson, Cumberland, RI (US); Juan J. Barrena, Johnston, RI (US); Mark A. Romo, Paw Paw, RI (US)

(73) Assignee: Illinois Tool Works Inc., Glenview, IL (US)

( * ) Notice: Subject to any disclaimer, the term of this patent is extended or adjusted under 35 U.S.C. 154(b) by 310 days.

(21) Appl. No.: 12/212,200

(22) Filed: Sep. 17, 2008

(65) Prior Publication Data

US 2009/0120135 A1 May 14, 2009

Related U.S. Application Data

(60) Provisional application No. 60/987,956, filed on Nov. 14, 2007.

(51) Int. Cl.
*D06F 33/02* (2006.01)

(52) U.S. Cl. ..... 68/12.05; 68/12.19; 68/12.27

(58) Field of Classification Search ..... 68/3 R, 68/12.16, 12.23, 12.27
See application file for complete search history.

(56) References Cited

U.S. PATENT DOCUMENTS

| | | | | |
|---|---|---|---|---|
| 2,888,531 | A * | 5/1959 | Bochan | 200/84 R |
| 4,428,088 | A * | 1/1984 | Getz et al. | 8/158 |
| 5,671,135 | A * | 9/1997 | Jorgensen et al. | 700/76 |
| 6,935,142 | B2 * | 8/2005 | Musser et al. | 68/12.16 |
| 2008/0308643 | A1 * | 12/2008 | Larson et al. | 236/12.1 |

FOREIGN PATENT DOCUMENTS

| | | |
|---|---|---|
| GB | 2 236 332 | * 4/1991 |
| JP | 10-277289 | * 10/1999 |

* cited by examiner

*Primary Examiner* — Frankie L Stinson
(74) *Attorney, Agent, or Firm* — Mark W. Croll; Paul F. Donovan

(57) ABSTRACT

A water level control for a washing machine provides an integrated unit that may replace standard mechanical water level controls with a microprocessor-based circuit that may provide for more sophisticated water management in a standard washing machine using a non-microprocessor cycle timer.

11 Claims, 2 Drawing Sheets

FIG. 3
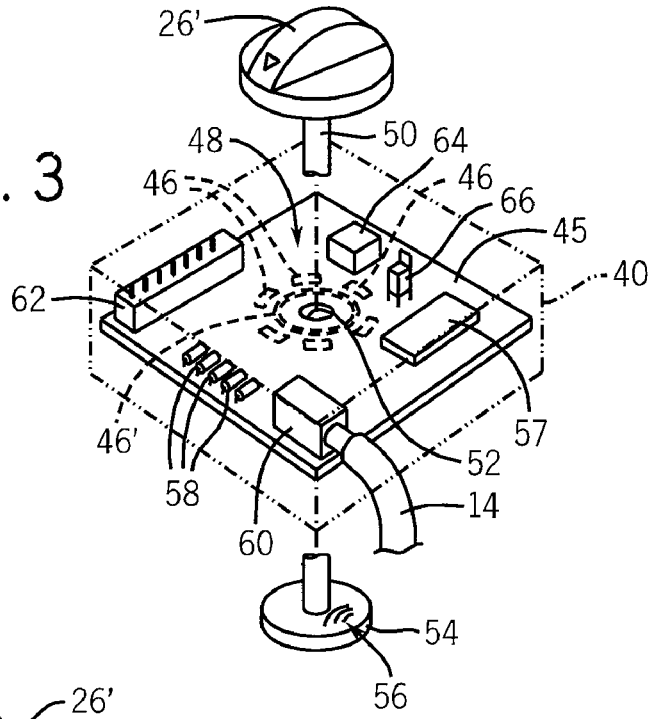
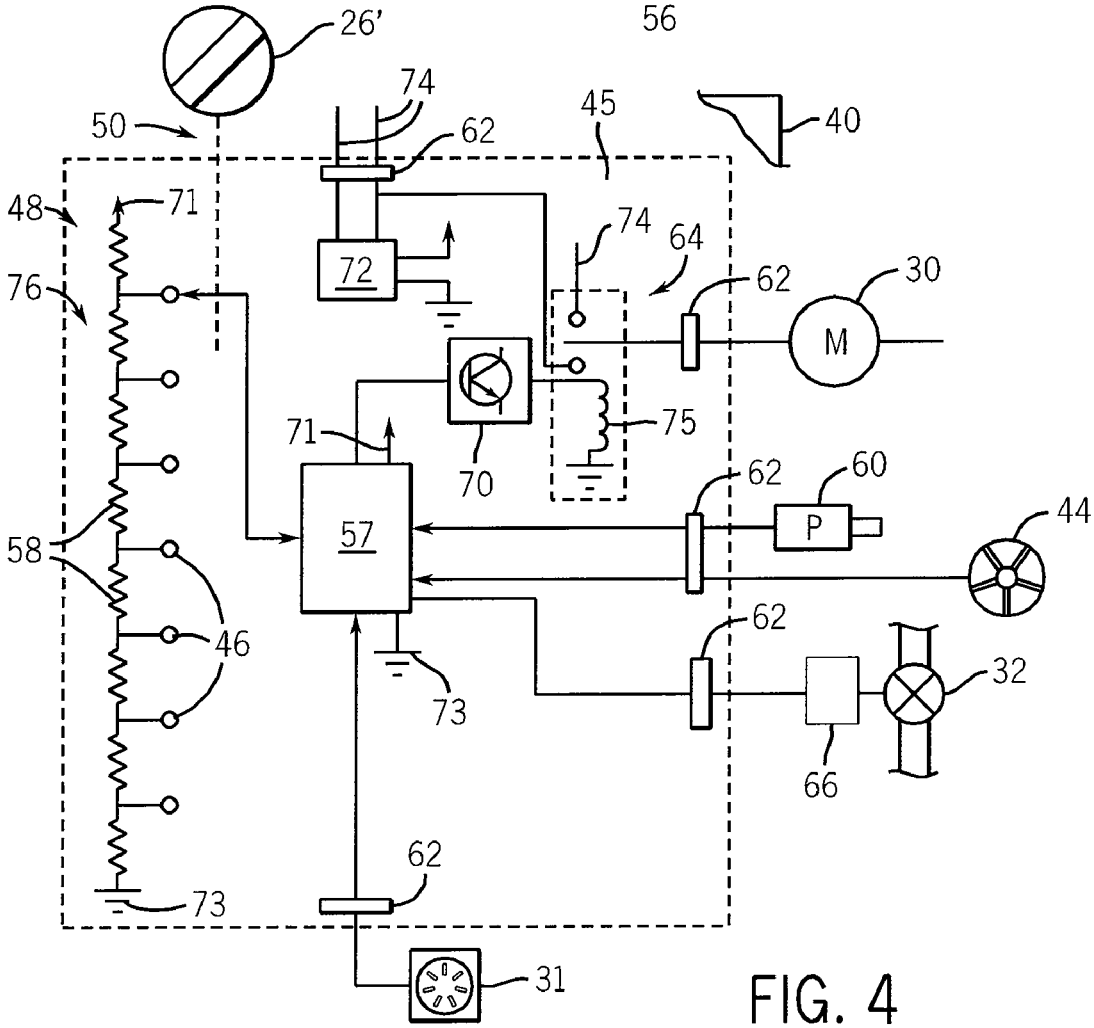
FIG. 4

METHOD AND APPARATUS FOR UPGRADING WASHING MACHINE WATER EFFICIENCY

CROSS REFERENCE TO RELATED APPLICATION

This Non-Provisional Application claims benefit to U.S. Provisional Application Ser. No. 60/987,956 filed Nov. 14, 2007 and which is hereby incorporated by reference.

FIELD OF THE INVENTION

The present invention relates generally to controls for household appliances and, in particular, to a water height control for washing machines providing improved water efficiency for standard washing machines.

BACKGROUND OF THE INVENTION

The present invention relates to controls for household appliances and, in particular, to a water height control for washing machines providing improved water efficiency for standard washing machines.

Conventional clothes washing machines provide for a tub for receiving clothing, water, and detergent and for providing agitation to clean clothing. The amount of water in the tub is typically controlled by a selector switch on the washing machine console. An electric valve is controlled to allow the tub to fill until a desired water level is sensed.

A well-established method of sensing the water level in the tub employs a pressure dome communicating with the tub to receive water from the tub into the dome. As the water rises, the pressure of trapped air in the dome increases. A mechanical pressure switch is attached to the dome to switch when a particular air-pressure has been reached.

The pressure switch used for this purpose typically provides a diaphragm working against a spring. The diaphragm is connected to a set of contacts that close or open when the diaphragm has been displaced by air pressure to a predetermined amount. The spring against which the diaphragm works may be preloaded by a cam that may be rotated by the user to adjust the desired water level setting. This mechanical pressure switch provides essentially a two state or binary pressure output.

High-end washing machines may provide for more sophisticated water management using a microprocessor control system handling all the functions of controlling the washing machine in addition to specialized cycles beyond those normally provided by a mechanical timer, such as multilevel temperature control (for example to optimize enzymatic action), directed detergent/bleach/softener injection, additional user signals (for example indicating that a garment may be added after the beginning of a cycle), delayed washing, child lockout, and improved water level control.

This latter feature of improved water level control can match the amount of water used to the size of the load saving as much as 23 gallons of water per load. This is done by using a solid-state pressure sensor that delivers a range of water level signals (rather than a switched binary signal per the mechanical pressure switch of the prior art) and a flow meter measuring the amount of water flowing into the tub. By determining the height of the water (through the pressure sensor) and the amount of water, the size of the load may be deduced and the proper total amount of water determined. Such sophisticated control is normally implemented through the use of a central control circuit board supporting a microprocessor and related control circuitry.

Improved control of water usage to match the size of the load being washed can have a significant environmental benefit but this feature is not normally available on lower end washing machines which do not require the range of features justifying full microprocessor control and which may be designed instead to employ a mechanical pressure switch and a mechanical cycle timer.

SUMMARY OF THE INVENTION

The present invention provides a near "drop in" replacement for a mechanical water level control obtaining analog pressure information and water flow information to allow improved water conservation even for low-end washing machines. The invention employs a low cost microprocessor and power interface circuitry making it cost-effective for standard washing machine designs and provides direct control of motor currents and valve currents in the manner of a mechanical pressure switch so as to integrate readily into such standard designs. The control of the present invention accepts a wiring harness allowing it to be flexibly connected to other washing machine components, for example the cycle timer, valve and motor, so a single unit may be used for many different washing machine models.

Specifically then, the present invention provides a water height control for a washing machine, the washing machine receiving a wash/rinse signal from a separate cycle timer or the like, and further including an electric water valve for controlling water flow into a tub of a washing machine and a motor for agitating clothing within the tub. The water height control comprises a housing providing a mounting element attaching the housing to a console of the washing machine and a connector system providing connection of a wiring harness between the housing and a separate wash/rinse control and cycle timer.

The housing holds: (a) a rotary switch having an operator extending through the housing to pass through a hole in the console for rotation by a user of the washing machine to set water height/usage, (b) a pressure sensor communicating with a port through the housing to receive a multistate pressure signal through a tube communicating with a tub of the washing machine, and (c) electronic circuitry including a microprocessor reading a signal from the rotary switch and the pressure sensor to control the water valve according to this estimate.

It is thus an object of at least one embodiment of the invention to provide a water height control that may permit sophisticated water management in standard washing machines. By providing the necessary electronics in the housing associated with the water level control switch and by employing harness connections communicating standard signals among arbitrarily placed cycle timers, motors, and valves, the invention permits replacement of mechanical water height controls for a range of different machines.

The electronic circuitry may further read a flow sensor to estimate the amount of clothing in the washing tub to control the water valve.

It is thus an object of at least one embodiment of the invention to provide a water height control that may react to different load sizes and optimize water height.

The flow sensor provides a set of pulses each corresponding to a given flow volume.

It is thus an object of at least one embodiment of the invention to permit a simple interface to a low cost microprocessor that may determine water flow by pulse counting on a single input.

The rotary switch may include contacts formed by traces of a printed circuit board, and the connector system and electronic circuitry may be attached to the printed circuit board to communicate electrically via traces of the printed circuit board.

It is thus an object of at least one embodiment of the invention to further reduce the cost of the control by integrating the switch and the printed circuit board holding the components necessary to effect the sophisticated water level control.

The rotary switch may communicate with a resistor ladder on the printed circuit board providing a variable voltage communicated to an analog-to-digital input of the microprocessor.

It is thus an object of at least one embodiment of the invention to permit a single microprocessor input to accommodate multiple water level/usage settings allowing use of a lower cost microprocessor.

The housing may further hold an electromechanical relay communicating with the microprocessor to switch currents providing power to the motor.

It is thus an object of at least one embodiment of the invention to permit high powered signals typically handled by a mechanical water level control to be controlled by the microprocessor of the present invention.

The pressure sensor may be a piezoelectric pressure sensor.

It is thus an object of at least one embodiment of the invention to provide the ability to distinguish among a range of water pressures and thus water levels.

The housing may further hold a triac communicating with the microprocessor to switch voltages on the electric water valve.

It is thus an object of at least one embodiment of the invention to permit the microprocessor to directly control the water valve in the manner of standard pressure switches.

Other features and advantages of the invention will become apparent to those skilled in the art upon review of the following detailed description, claims and drawings in which like numerals are used to designate like features.

BRIEF DESCRIPTION OF THE DRAWINGS

FIG. 3 is a perspective view in phantom of the housing of the water-conserving control of the present invention showing integration of the components on a single circuit board; and FIG. 4 is a schematic block diagram of the elements of the circuit board of FIG. 3.

Figure 1:
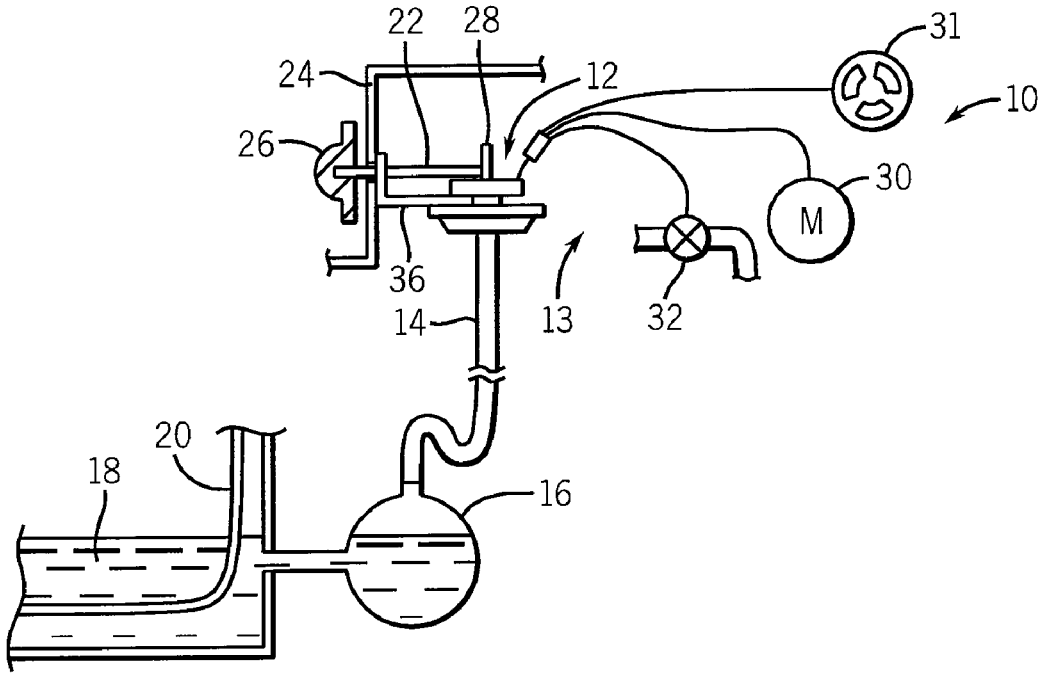
FIG. 1 PRIOR ART
FIG. 1 is a simplified diagram of a prior art mechanical water level control positioned behind a console to receive a water level setting through a rotating operator, and further receiving air pressure from a pressure dome communicating with a washing machine tub to control water flow valves and an agitator motor.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a prior art washing machine 10 may employ a mechanical water level control 12 of conventional design having an internal diaphragm (not shown) providing a pressure switch communicating on one side with a hose 14 connected to a pressure dome 16. Water 18 filling the wash tub 20 of the washing machine 10 flows into the pressure dome 16 compressing air at the top of the pressure dome 16 communicating to the pressure switch of the mechanical water level control 12 to move the diaphragm of the pressure switch upward (as oriented in FIG. 1) against the action of an internal spring (not shown).

The mechanical water level control 12 may have a shaft 22 passing through a console panel 24 to a rotary knob 26. The knob 26 may be rotated to set a water level by turning the shaft 22 which communicates with a cam 28 to change the compression of the internal spring on the diaphragm of the pressure switch of the mechanical water level control 12. Thus, different air pressures may be set corresponding to more or less air in the pressure dome 16 and to more or less water in the wash tub 20.

The pressure switch of the mechanical water level control 12 may communicate with internal switch contacts (not shown) driven by the diaphragm. These internal switch contacts directly control power to an agitator motor 30, water flow control valves 32 and for this purpose, may communicate via a harness 13 with the agitator motor 30 and the water control valves 32 and with a cycle timer 31 and a wash/rinse control 34 (the latter two also on the console). The contacts may receive a signal from a wash/rinse control 34 and or cycle timer 31 and may provide signals controlling valves 32 and agitator motor 30.

The mechanical water level control 12 may include a bracket 36 mounting it to the back side of the console panel 24 to allow it to be independently positioned in various different locations as required for different models of washing machines.

Figure 2:
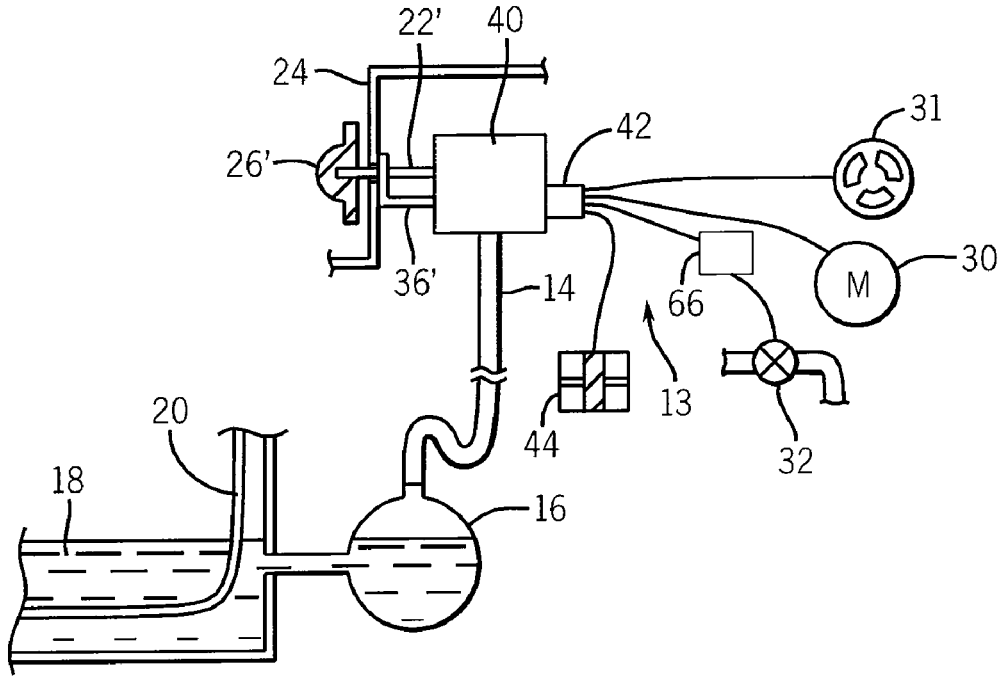
FIG. 2 is a figure similar to that of FIG. 1 showing the water conserving control of the present invention working as a drop-in replacement for the prior art mechanical control of FIG. 1.

Referring now to FIG. 2, the present invention provides a drop-in replacement for the mechanical water level control 12 having a housing 40 with a bracket 36'. The bracket 36' may have a hole pattern identical to that of the bracket 36 of mechanical water level control 12 and the housing 40 may have a form factor allowing it to be positioned in the same location as the mechanical water level control 12. In this way, the housing 40 may be a drop-in replacement for the mechanical water level control 12.

Like the mechanical water level control 12, the housing 40 provides a shaft 22' passing through the console panel 24 to be received by a knob 26'. A connector 42 on the rear of the housing 40 communicates with a wire harness 13 connecting to agitator motor 30, valves 32, and cycle timer 31 (providing a wash/rinse signal), and hose 14 communicating with pressure dome 16 (not shown in FIG. 2). The connector 42 also may connect to a water flow sensor 44 as is necessary to provide energy-efficient water management as was described above.

Referring now to FIG. 3, the housing 40 may hold a printed circuit board 45 having on its lower surface a set of traces including those forming the pads 46 of a single pole, seven throw rotary switch 48. The knob 26' attaches to a shaft 50 passing through an opening 52 in the printed circuit board 45 to connect with a wiper assembly 54 on the opposite side of the printed circuit board 45. The wiper assembly 54 has conductive wipers 56 selectively connecting circumferentially separated pads 46 of the rotary switch 48 to a common coaxial ring pad 46' to form the multi-pole rotary switch 48.

The printed circuit board 45 may also support a microprocessor 57, an array of resistors 58, a pressure sensor 68, a connector 62 (joinable with connector 42), and a microprocessor 57, as will be described below, all interconnected by means of pads 46 (not shown). Other components (described below but not depicted in FIG. 3) are also attached to the printed circuit board 45 to provide, for example, a power supply suitable for operation of the microprocessor 57 and driving circuitry for the relay 64. All these components within the housing 40 provide a self-contained unit that may be mounted behind the console panel 24.

Referring now also to FIG. 4, the microprocessor 57 may be a low-cost microprocessor having as few as two digital inputs, two digital outputs and two analog inputs. The two digital inputs receive a wash/rinse input from the cycle timer 31 and a pulse input from the flow sensor 44, respectively. The two analog inputs may receive the analog pressure signal from the pressure sensor 60 and from the rotary switch 48, respectively. The pressure sensor 60 may be a piezoelectric sensor providing a variable voltage indicating multiple pressure states and thus multiple water heights. The two digital outputs communicate with and external automatic water temperature control 66 controlling power to valve system 32 based on temperature according to the teachings of U.S. Pat. No. 6,935,142, and with a transistor driver 70 controlling power to a coil 75 of the relay 64, in turn controlling motor current to agitator motor 30.

The different poles of the rotary switch 48, described above, are each attached to junctions between resistors 58 of a resistor ladder 76, the latter comprising a series connection of the resistors 58 between DC voltage 71 and ground 73. In this way, position of the knob 26' is reflected in a different voltage provided to the analog input of microprocessor 57.

Power for the microprocessor 57 is provided by power supply circuitry 72, for example a rectifier and filter capacitor followed by a solid-state voltage regulator, which converts line power 74 to microprocessor level DC voltage 71 referenced to a circuit board ground 73. The power supply circuitry 72 may also be contained on the printed circuit board 45.

During operation, the microprocessor 57 may read the desired water level setting from the rotary switch 48. This setting may indicate one of a set of discrete water levels, or more simply may provide for a limited number of automatic settings where the water height is set to an optimum level based on other conditions, for example whether or not fabric softener is being used. The meaning of the setting of rotary switch 48 is determined by software running in the microprocessor 57.

For a typical automatic setting, the microprocessor 57 receives water flow information and pressure information from flow sensor 44 and pressure sensor 60, respectively, to deduce the size of the load in the wash tub 20. This deduction looks at the rate of change of pressure (and hence water head) as a function of volume of water and may be used, for example, to provide more accurate water level adjustments that accommodate knowledge about the amount of water necessary to optimally clean the given load size.

The amount of water is also a function of whether the washing machine 10 is in a wash or rinse cycle as determined by a signal from the cycle timer 31.

The connectors 62 attached to the circuit board 45 allow the present invention to be used with a variety of different wiring harnesses 13 so that it may be incorporated into different washing machine models allowing it to be standardized for increased economies of scale.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A water height control for a washing machine, the washing machine having a separate cycle timer and further including an electric water valve for controlling water flow into a tub of a washing machine and a motor for agitating clothing within the tub, the water height control comprising:

a housing providing a mounting element attaching the housing to a console of the washing machine, a connector system providing connection of a wiring harness between the housing and a separate wash/rinse control and cycle timer;

the housing holding:

(a) a rotary switch having an operator extending through the housing to pass through a hole in the console for rotation by a user of the washing machine to set water height/usage;

(b) a pressure sensor communicating with a port through the housing to receive a multistate pressure signal through a tube communicating with a tub of the washing machine, the multistate pressure signal providing an analog pressure signal indicating one of different multiple water heights greater than two water heights;

(c) a water flow sensor measuring a volume of water flowing through the valve into the tub; and (d) electronic circuitry including a microprocessor reading a signal from the rotary switch and the pressure sensor and flow sensor to estimate an amount of clothing in the washing tub to control the water valve according to this estimate.

2. The water height control of claim 1 wherein the flow sensor provides a set of pulses each corresponding to a given flow volume.

3. The water height control of claim 1 wherein the connector system further provides connection to a wiring harness between the housing and the flow sensor.

4. The water height control of claim 1 wherein the rotary switch includes contacts formed by traces of a printed circuit board, and the connector system and electronic circuitry are attached to the printed circuit board to communicate electrically via traces of the printed circuit board.

5. The water height control of claim 4 wherein the rotary switch communicates with a resistor ladder on the printed circuit board providing a variable voltage communicated to an analog-to-digital input of the microprocessor.

6. The water height control of claim 1 wherein the housing further holds an electromechanical relay communicating with the microprocessor to switch currents providing power to the motor.

7. The water height control of claim 6 wherein the connector system further provides connection to a wiring harness between the housing and the motor.

8. The water height control of claim 1 wherein the pressure sensor is a piezoelectric pressure sensor.

9. The water height control of claim 1 wherein the connector system further provides connection to a wiring harness between the housing and the electric water valve.

10. The water height control of claim 1 wherein the electronic water valve provides a temperature control of water filling the tub.

11. A water height control for a washing machine, the washing machine having a separate cycle timer and further including an electric water valve for controlling water flow into a tub of a washing machine and a motor for agitating clothing within the tub, the water height control comprising:

a housing providing a mounting element supporting the housing behind a console of the washing machine, the housing holding:

(a) at least one electrical connector for attachment of a wiring between the housing and the separate cycle timer, motor, and valve;

(b) a multi-position switch having an operator extending through the housing to pass through a hole in the console for rotation by a user of the washing machine to set water height/usage;

(c) a pressure sensor communicating with a port through the housing to receive a multistate pressure signal through a tube communicating with a tub of the washing machine, the multistate pressure signal providing an analog pressure signal indicating one of different multiple water heights greater than two water heights;

(d) a water flow sensor measuring a volume of water flowing through the valve into the tub;

(e) a microprocessor reading a signal from the multi-position switch and the pressure sensor and flow sensor to estimate an amount of clothing in the washing tub to provide a motor control signal and a water valve control signal, the latter according to this estimate of the amount of clothing;

(f) electromagnetic relay receiving the motor control signal to switch motor power to the motor; and (g) a triac receiving the water valve control signal to switch control signals to the water valve.

* * * * *